US005974294A

United States Patent [19]

Tange

[11] Patent Number: 5,974,294

[45] Date of Patent: Oct. 26, 1999

[54] FIXING DEVICE HAVING INFRARED TRANSPARENT MEMBER

[75] Inventor: Keigo Tange, Okazaki, Japan

[73] Assignee: Minolta Co., Ltd., Osaka, Japan

[21] Appl. No.: 09/072,673

[22] Filed: May 6, 1998

[30] Foreign Application Priority Data

May 22, 1997 [JP] Japan ..... 9-132218

[51] Int. Cl.[6] ..... G03G 15/20

[52] U.S. Cl. ..... 399/328; 219/216; 399/330

[58] Field of Search ..... 399/122, 320, 399/328, 330–333; 219/216

[56] References Cited

U.S. PATENT DOCUMENTS

| | | | |
|---|---|---|---|
| 3,945,726 | 3/1976 | Ito et al. | 219/216 |
| 3,948,214 | 4/1976 | Thettu | 219/216 X |
| 4,163,892 | 8/1979 | Komatsu et al. | 219/216 |
| 5,242,364 | 9/1993 | Uchida et al. | 347/104 |
| 5,602,635 | 2/1997 | Domoto et al. | 399/328 |
| 5,774,763 | 6/1998 | Muramatsu | 399/69 |

FOREIGN PATENT DOCUMENTS

| | | |
|---|---|---|
| 4-98280 | 3/1992 | Japan . |
| 5-61371 | 3/1993 | Japan . |
| 5-303300 | 11/1993 | Japan . |
| 6-35354 | 2/1994 | Japan . |
| 7-121041 | 5/1995 | Japan . |
| 7-146620 | 6/1995 | Japan . |
| 8-137313 | 5/1996 | Japan . |
| 8-179648 | 7/1996 | Japan . |
| 8-234611 | 9/1996 | Japan . |

*Primary Examiner*—Arthur T. Grimley
*Assistant Examiner*—Quana Grainger
*Attorney, Agent, or Firm*—Burns, Doane, Swecker & Mathis, LLP

[57] ABSTRACT

A fixing device includes a hollow cylindrical sleeve provided to surround a hollow glass roller containing a halogen heater therein, and a pressure roller that contacts and presses the glass roller and the sleeve. The glass roller is made of an infrared-transparent material. The sleeve has an inner diameter larger than the outer diameter of the glass roller and it is heated by absorbing infrared rays from the halogen heater. The pressure roller nips and holds the sheet carrying the toner between itself and the glass roller and as the sleeve.

26 Claims, 3 Drawing Sheets

FIXING DEVICE HAVING INFRARED TRANSPARENT MEMBER

BACKGROUND OF THE INVENTION

1. Field of the Invention

The present invention relates to a fixing device used on electrophotographic copying machines, printers and facsimile (transmitting and receiving) equipment, in particular, and to an improvement on such a fixing device for fixing toner images on recording media using a radiating heat source.

2. Description of the Related Art

An electrophotographic copying machine has a fixing device for fixing toner images transferred onto recording media such as a sheet of recording paper or transfer material. Various kinds of fixing devices are known. A typical thermal roller type fixing device comprises a fixing roller, which is sometimes called a heat roller, that thermally fuses the toner on the sheet, and a pressure roller, which is sometimes called a backup roller, that presses upon the fixing roller to nip and hold the sheet in place. The fixing roller is formed in the shape of hollow cylinder. A heat source is held on the longitudinal axis of this fixing roller by means of a holding apparatus.

A typical fixing roller found in a conventional thermal fixing device comprises a metallic body made of aluminum, iron or the like, the surface of which is covered with a releasing material such as silicon rubber and PTFE (polytetrafluoroethylene). It is sometimes coated with a certain type of oil such as silicon oil as needed. On the other hand, the pressure roller typically comprises a metallic core coated with heat-resistant rubber such as silicon rubber, the surface of which is covered with a plastic tube made of Teflon if need be.

The heat source comprises a tube-like heater such as a halogen lamp, which heats up when a predetermined voltage is supplied. Since this halogen lamp is on the longitudinal axis of the fixing roller, the inner wall of the fixing roller is irradiated evenly with the heat generated by the halogen lamp, and the distribution of temperature of the outer wall of the fixing roller becomes uniform as to the circumferential direction. Then, the outer wall of the fixing roller is heated up to a temperature suited for fixation (e.g., 150–200° C.).

Under such a condition, the fixing roller and the pressure roller rotate in directions opposite to each other, nipping and holding the sheet that is attached with the toner. At an area of pressure between the fixing roller and the pressure roller (hereinafter called the "nipping area"), the toner on the sheet is fused by the heat from the fixing roller and is fixed on the sheet by the pressure applied between the two rollers. After the toner is fixed, the sheet is transferred by the paper discharge roller and discharged on an output tray.

In such a fixing device, the heat transfer to the fixing roller is based on the heat radiation from the halogen lamp built therein. In order to transmit the heat efficiently, the inner surface of the fixing roller is coated with a black paint of heat-resistant resin with a high thermal radiation to achieve the thermal radiation of the inner surface of the fixing roller higher than "0.9". This allows the fixing roller to be efficiently heated.

A fixing device equipped with a radiant heater consisting of a halogen lamp or a similar unit is basically a heating apparatus relying on radiation heat. Therefore, it takes a certain time to heat the fixing roller to a predetermined temperature suitable for fixation after the power source is turned on (hereinafter called "warm up time") no matter how high the thermal radiation of the fixing roller is. On the other hand, in order to increase the value of a product such as a copying machine, it is considered important to make the equipment more compact, as well as to make the fixing device more energy efficient (lower power consumption) and to make the user's operation easier (quicker print).

In case of the conventional fixing device described above, there is a limit in the electric power to be supplied to the radiant heat source due to the constraints arising from the equipment specifications. The only way, therefore, to shorten the warm up time is to reduce the thermal capacity of the fixing roller. Thus, various schemes have been tried to reduce the thickness of the roller, particularly to make the thickness of the base body as thin as possible.

However, reduction of the thickness of the fixing roller results in the drop of the rigidity of the fixing roller, which in turn causes deformations of the roller under high temperature conditions and deterioration of paper feeding performances. If, on the other hand, a lower pressure is used to avoid such a roller deformation, it causes a deterioration of fixing performance. Because of these problems, there is a limit to the thinning of the fixing roller, so that there has been a limitation to the shortening of the warm up time by means of the thinning of the fixing roller.

SUMMARY

The purpose of the present invention is to provide a fixing device equipped with a radiant heat source that is capable of reducing the warm up time and of securing a sufficient pressing force at the same time.

One aspect of this invention is a fixing device that fixes an unfixed image, which is formed on a recording medium, onto the recording medium. The fixing device includes a radiant heat source that radiates infrared rays; an infrared transparent hollow cylindrical member that has the radiant heat source installed therein; an endless heating rotary member that has the cylindrical member installed therein and is heated by infrared rays from the radiant heat source through the cylindrical member; and a pressure rotary member that is disposed to contact and press the heating rotary member to nip and transport the recording medium, which is holding an unfixed image.

Another aspect of this invention is an image recording apparatus that includes an image forming unit that forms unfixed images on recording media; and a fixing device that receives the recording media holding unfixed images formed in the image forming unit and fixes the unfixed images on the recording media, the fixing device comprising a radiant heat source that radiates infrared rays, an infrared transparent hollow cylindrical member that has the radiant heat source installed therein, an endless heating rotary member that has the cylindrical member installed therein and is heated by infrared rays from the radiant heat source through the cylindrical member, and a pressure rotary member that is disposed to contact and press the heating rotary member to nip and transport the recording medium, which is holding an unfixed image.

Under such a constitution, most of the infrared rays emitted by the radiant heat source reach the inner surface of a heating rotary member through a hollow cylindrical member to be absorbed by the heating rotary member. Thus the heating rotary member is heated and its temperature rises. The heat capacity of the heating rotary member is sufficiently smaller than the energy absorbed so that the heating rotary member's temperature rises sharply and reaches the temperature suitable for fixing. Moreover, since the pressing force of the pressure rotary member is born by the hollow cylindrical member, there is no need for the heating rotary member to have an excessive rigidity. Thus, it is possible to make the wall thickness of the heating rotary member thinner to lower the heat capacity.

As a result, this fixing device serves to reduce the heat energy loss during the process of heating the heating rotary member and to increase the temperature rising speed of the heating rotary member, thus reducing the warm up time, as well as to secure a sufficient pressing force required for fixing by means of the hollow cylindrical member, thus preventing deterioration of the fixing capability of the unit.

The objects, features, and characteristics of this invention other than those set forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

Figure 1:
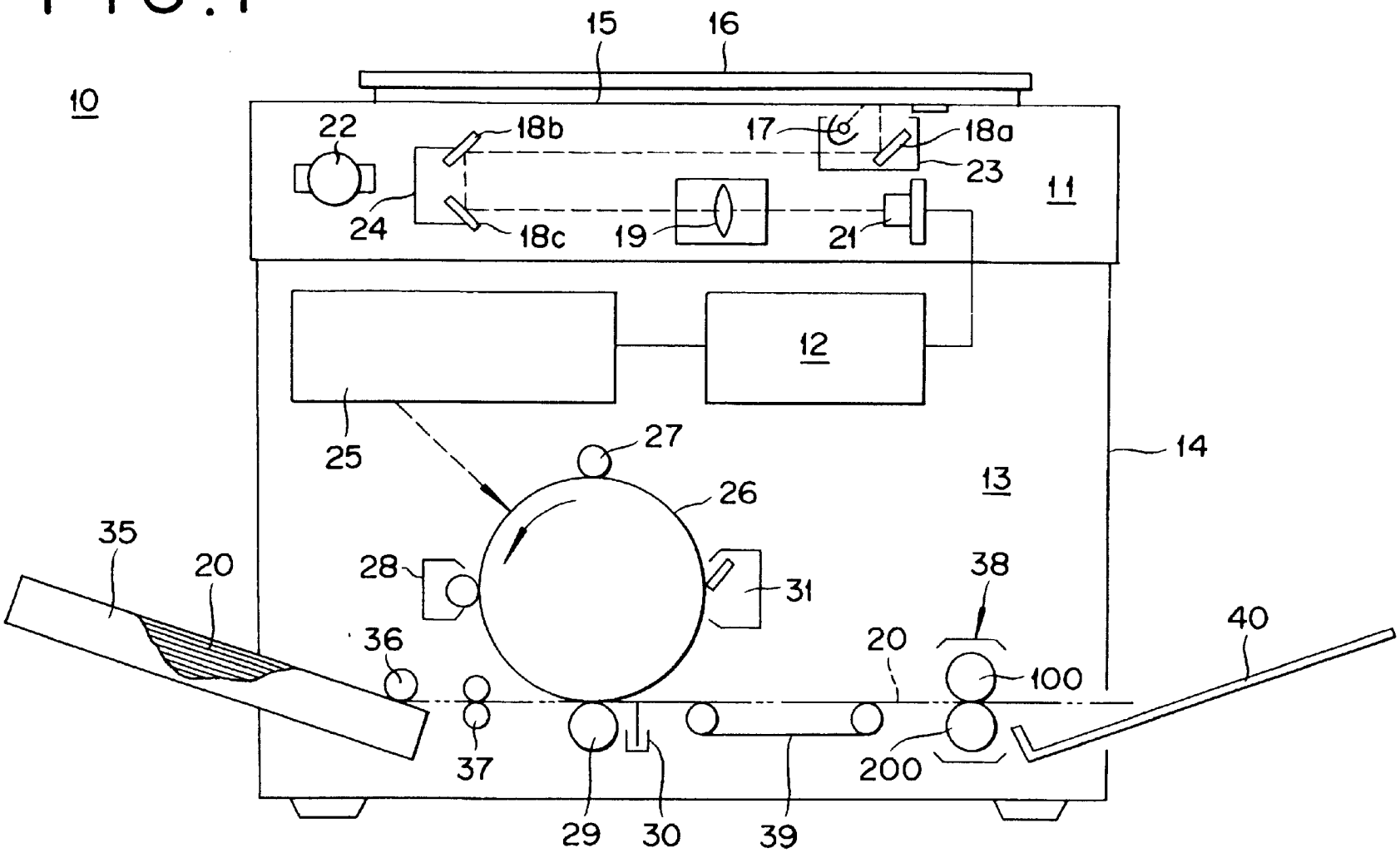
FIG. 1 is a schematic drawing of a copying machine equipped with a fixing device as an image forming apparatus according to the first embodiment of the present invention.

FIG. 1 is a schematic drawing of a copying machine equipped with a fixing device as an image forming apparatus according to the first embodiment of the present invention.

A copying machine 10 comprises: an image scanner 11 that reads documents; a signal processing unit 12 that processes signals; a printer 13 that prints out on sheets 20 the images, which correspond to the document images read by the image scanner 11; and a casing 14 that houses all of these components.

A document placed on a platen glass 15 in the image scanner 11 is held down by a platen cover 16. However, if an automatic operation of feeding documents is required, the platen cover 16 will be replaced by an automatic document feeder.

The document on the platen glass 15 is irradiated by a lamp 17. The light reflected from the document goes through mirrors 18*a*, 18*b*, and 18*c* as well as a condensing lens 19 to form an image on a line sensor (CCD) 21, which converts it to an image signal and send it to the signal processing unit 12. When a scanner motor 22 is activated, a first slider 23 moves with a speed V, and a second slider 24 with a speed V/2 mechanically in a direction (auxiliary scanning direction) perpendicular to an electrical scanning direction (main scanning direction) of the line sensor to scan the entire surface of the document.

The signal processing unit 12 electrically processes the signal read by the line sensor 21 and sends it to the printer 13.

The printer 13 comprises a laser generator 25 and a photoconductor drum 26 whose function is to hold the image. Surrounding the rotatable photoconductor drum 26 are located such parts as: a charging roller 27 as a charging means; a development unit 28; a transfer roller 29 as a transfer means; an erasing needle 30 that removes static electricity from the sheet 20 to facilitate its separation; and a cleaning device 31 that removes remaining toner from the photoconductor drum 26.

The laser generator 25 modulates the semiconductor laser according to the image signal level being sent from the signal processor 12. The laser light goes through a polygon mirror, a f-θ lens and a turnaround mirror, which are not shown here, and is irradiated on the photoconductor drum 26 between the charging roller 27 and the development unit 28. The electrostatic latent image formed on the photoconductor drum 26 is developed by the toner in the development unit 28.

On the other hand, a supply cassette 35 mounted on the casing 14 in a detachable manner stores multiple sheets of paper 20 in a stacking condition. The sheets 20 in the supply cassette 35 are fed one sheet at a time with the help of a paper feed roller 36 and sent into the transfer position between the photoconductor drum 26 and the transfer roller 29 at a predetermined timing controlled by timing rollers 37. The image developed on the photoconductor drum 26 is transferred to the sheet 20 with the help of the transfer roller 29. After the transfer, the sheet 20 is separated from the photoconductor drum 26 and is transported towards the fixing device 38 by means of a transporting belt 39. The unfixed toner transferred on the sheet 20 is fused by the fixing device 38. The sheet 20 with the fixed toner is discharged to an output tray 40. The fixing device 38 of this embodiment is equipped with a radiant heat source within the fixing roller, and its constitution will be explained later.

When the transfer to the sheet 20 by the transfer roller 29 is completed, the surface of the photoconductor drum 26 will be charged to a negative polarity by means of a charger (not shown) prior to the cleaning. After the remaining toner is removed by the cleaning device 31, the remaining charges are removed by an eraser (not shown). Then, the drum is charged again by the charging roller 27, receives another latent image from the laser light, which will be developed by the development unit 28 and the charges in the non-developed area are removed by an eraser (not shown) prior to the transfer.

Figure 2:
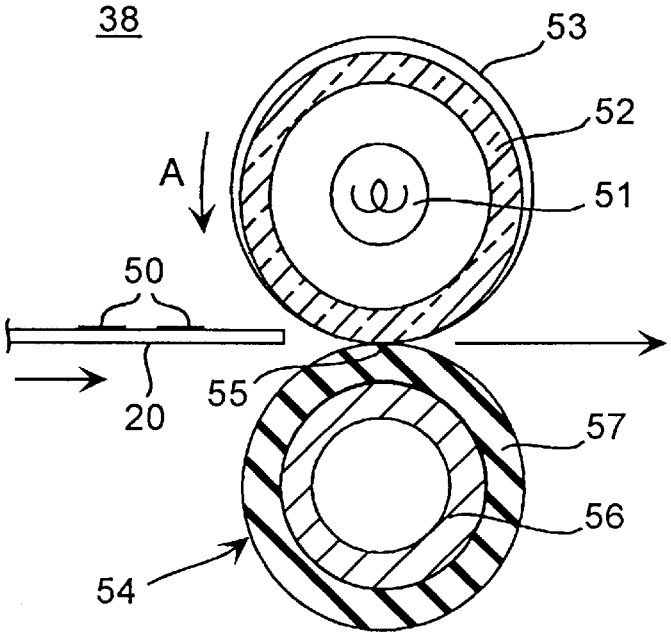
FIG. 2 is a schematic vertical cross-sectional drawing of the fixing device shown in FIG. 1.
Figure 3:
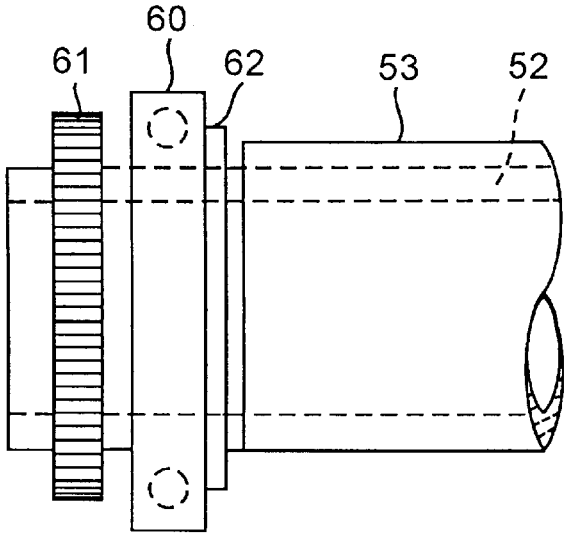
FIG. 3 is a front view of the ends of a glass roller and a sleeve.

FIG. 2 is a schematic vertical cross section of the fixing device shown in FIG. 1 and FIG. 3 is a front view showing the end of the glass roller and the sleeve.

The purpose of the fixing device 38 shown here is to fix toner 50, which is held on the sheet 20, onto the sheet 20 by means of heating and fusing. The fixing device 38 comprises: a halogen heater (corresponds to the radiant heat source) 51, a hollow cylindrical glass roller (corresponds to the hollow cylindrical member) 52 that has a halogen heater 51 built therein, a hollow cylindrical sleeve (corresponds to the heating rotary member) 53 provided to surround the glass roller 52; and a pressure roller (corresponds to a pressure rotary member) 54 that presses the glass roller 52 and the sleeve 53.

The glass roller 52 is made of an infrared-transparent material. The sleeve 53 has an inner diameter larger than the outer diameter of the glass roller 52, and its temperature rises as it absorbs the infrared rays from the halogen heater 51. The pressure roller 54 nips and holds the sheet 20, which is carrying the toner 50, between itself and the glass roller 52 and the sleeve 53. The glass roller 52 is installed rotatably in the direction of arrow A as shown in FIG. 2. The sleeve 53 and the pressure roller 54 are driven to rotate by the glass roller 52.

Explaining in more detail, the glass roller 52 is made of a heat-resistant glass as a PYREX glass ("PYREX" is a trademark of Corning Glass), or a quartz glass with a high infrared ray transparency. The glass roller 52 should preferably have a thickness of 0.5–5 mm in order to create a nipping area 55 between it and the pressure roller 54 under a pressure from the pressure roller 54. The outer diameter of the pressure roller 54 should preferably be 15 mm from the standpoint of securing the nipping area 55 between it and the glass roller 52 and also of preventing any excessive deformation due to the pressing. The upper limit of the outer diameter of the pressure roller 54 is about 100 mm, although it depends on the paper pass speed. With such a constitution, it is possible to fix 200 sheets (A4 size) per minute.

The sleeve 53 is made of nickel product manufactured by electrocasting, which may easily provide a thin sleeve. However, the material of the sleeve 53 is not limited to the material; any material that provides a high thermal conductivity and does not cause any temperature fluctuation in the lengthwise direction (axial direction of the glass roller 52) can be used. For example, thin tube made of copper, aluminum, their alloys and stainless steel can be used just as well.

From the standpoint of reducing the warm up time, it is advantageous to reduce the heat capacity of the sleeve 53 by making the sleeve 53 as thin as possible. However, the sleeve 53 has to have a certain thickness to maintain the structural strength and to maintain a uniform temperature for handling the paper. The sleeve 53 needs to be thicker than 20 $\mu$m; practically speaking, it is preferable to be 40 $\mu$m to 2 mm.

The inner surface of the sleeve 53 is coated with a heat-resistant black paint to enhance its radiation absorption rate. This is to make the sleeve 53 raise its temperature more efficiently by absorbing the radiation from the halogen heater 51 more efficiently. A separation layer is formed on the outermost layer, or the outer circumference of the sleeve 53 in order to improve its separation from the sheet 20. The separation layer is made of heat-resistant plastics such as PTFE (polytetrafluoroethylene) and PFA (perfluoroalkoxifluororesin).

As to the inner diameter of the sleeve 53, it is acceptable as long as it is larger than the outer diameter of the glass roller 52 as it is fitted into the glass roller 52. However, from the standpoint of reducing the heat capacity, it is preferable not to be too large. On the other hand, if the inner diameter of the sleeve 53 is about equal to the outer diameter of the glass roller 52, the contact surface between them increases. As a result, the heat absorbed by the sleeve 53 from the radiation of the halogen heater 51 may escape to the glass roller 52 by convection, thus to weaken the warm up time reduction effect. Therefore, it is preferable that the inner diameter of the sleeve 53 is several percent larger than the outer diameter of the glass roller 52. The contact between the sleeve 53 and the glass roller 52 shall be limited to the nipping area 55 and its vicinity.

The pressure roller 54 comprises a core 56 and a rubber layer 57 formed to surround it. The rubber layer 57 has a characteristic to facilitate the separation of the sheet 20 from its surface, and also has a good heat resistance. The pressure roller 54 is urged in the direction toward the glass roller 52 and the sleeve 53 by springs (not shown).

The specific examples of the glass roller 52, sleeve 53, and pressure roller 54 are as follows: The glass roller 52 has an outer diameter of 28 mm, a thickness of 3 mm, and a length of 340 mm and is made of Pyrex glass ("PYREX" is a trademark of Corning Glass). The sleeve 53 is an electrocasted cylinder of nickel, the inner surface being coated with a heat-resistant black paint with and the outer surface coated with PTFE (polytetrafluoroethylene), having an inner diameter of 30 mm and a wall thickness of 40 $\mu$m. The pressure roller 54 comprises a core made of stainless steel having an outer diameter of 20 mm and a rubber layer having a thickness of 5 mm and a hardness of 30Hs (JIS-A) formed outside thereof.

As shown in FIG. 3, the glass roller 52 is rotatably supported by a bearing 60 on each end, and mounted on a fixing unit frame not shown in the figure. A gear 61 is attached on one end of the glass roller 52. A low-friction member 62 made of PTFE (polytetrafluoroethylene), etc., is provided on the inner side of the bearing 60, which comes in contact with the sleeve 53, in order to prevent a possible damage of the sleeve 53 due to friction. The gear 61 affixed to the end of the glass roller 52 engages with a gear, to which the drive power of a motor (not shown) is delivered. Therefore, the glass roller 52 is driven by the motor.

When the glass roller 52 rotates in the direction of arrow A shown in FIG. 2, the sleeve 53 is driven thereby together with the pressure roller 54, as it is being nipped between the glass roller 52 and the pressure roller 54 at the nipping area 55 and travels in the direction of the paper feed. The heater 51 lying through the interior of the glass roller 52 is supported at both ends by a supporting means (not shown) and attached to the fixing unit frame. The halogen heater 51 is connected to the power source of the copying machine 10 via a switch (not shown) to receive a voltage during the heating control.

The fixing device thus constituted operates as follows:

When the user presses a copying button, or when the unit receives print data from a computer, the print start signal will be outputted to start forming an image; simultaneously, the halogen heater 51 is turned on and the infrared radiation from the halogen heater 51 starts.

Most of the infrared rays from the halogen heater 51 pass through the glass roller 52 and reach the inner surface of the sleeve 53 to be absorbed by the sleeve 53. As a result, the sleeve 53 gets heated and its temperature rises. The inner surface of the sleeve 53 is coated with black paint to increase its radiation absorption rate, so that it can easily absorb the heat provided by the infrared rays that has passed through the glass roller 52 and minimizes the energy loss. The heat capacity of the sleeve 53 is small enough compared with the energy absorbed so that the temperature of the sleeve 53 quickly rises to a temperature suitable for fixing. Moreover, the thermal conductivity of the glass roller 52 is smaller than that of the sleeve 53; also, its area of contact with the sleeve 53 is small. Therefore, the heat escaping from the sleeve 53 to the glass roller 52 is small. In case of the embodiment described above, the temperature of the sleeve 53 reached 150° C., the temperature that is suitable for fixation, within 4 seconds when the voltage applied to the halogen heater 51 is set at 800 W.

While the sleeve 53 is heated up to the predetermined temperature, the toner image formed by a known image forming process is transferred onto the sheet 20 by means of the transfer roller 29 and then transported to the fixing device 38 by means of the transporting belt 39.

In order to heat the sleeve 53 and to prevent the temperature unevenness, the glass roller 52 is driven and is rotating together with the sleeve 53 and the pressure roller 54 before the fixation starts. The sheet 20, which has been transported from the left side of FIG. 2 to the nipping area 55, is nipped between the sleeve 53 and the pressure roller 54 and transported. The toner 50 that is held on the sheet 20 is fused at the nipping area 55 by the heat of the sleeve 53, and is fixed onto the sheet 20 due to the pressure applied by the pressure roller 54. After the toner 50 is fused and fixed, the sheet 20 is separated from the sleeve 53 by means of the curvature separation action of the curvature of the sleeve 53 or a separation claw (not shown) and discharged to the output tray 40.

During the fixing operation, the power supplied to the halogen heater 51 is controlled to maintain an approximately constant temperature (normally 150–200° C.) of the sleeve 53. There are several methods to the temperature control; for example, the method of controlling the supplied power based on the temperature of the sleeve 53 measured by placing a thermistor on its surface; a method of controlling the temperature by measuring the temperature of the sleeve 53 by a non-contacting means such as thermopile; a method of controlling based on the sequence or the ambient temperature; and combination of these methods.

The fixing device 38 of this embodiment has a constitution of receiving the pressing force of the pressure roller 54 with the glass roller 52. Therefore, there is no need for providing a large rigidity to the sleeve 53, which is heated by the halogen heater 51, and is possible to make the wall of the sleeve 53 as thin as possible to keep its heat capacity low. Also, since the glass roller 52 can easily pass the infrared rays from the halogen heater 51, it is easy to heat the sleeve 53 by effectively using the thermal energy generated at the halogen heater 51. Moreover, the heat dissipation from the sleeve 53 to the glass roller 52 is kept minimum. Consequently, the fixing device 38 reduces the thermal energy loss during the heating of the sleeve 53, increases the rate of temperature rise of the sleeve 53, reduce the warm up time, and realizes a energy efficient device. Moreover, since the pressing force required for fixing is sufficiently provided by the glass roller 52, the deterioration of the fixing capability is prevented.

In the above-mentioned embodiment, the glass roller 52 is the driver member. However, it is also possible to make the pressure roller 54 function as the driver, and make the sleeve 53 and the glass roller 52 as the driven members. If the pressure roller 54 is the driver, it is also possible to fix the glass roller 52 and make only the sleeve 53 be the driven member.

Further, although the "hollow cylindrical member" was identified as the "glass roller 52" in the above explanation, glass is not the only material that can be used for the hollow cylindrical member, but rather other materials with a good infrared transparency and heat-resisting property can be used as well. For example, a transparent heat-resistant plastic material may be used to build a hollow cylindrical member.

Figure 4:
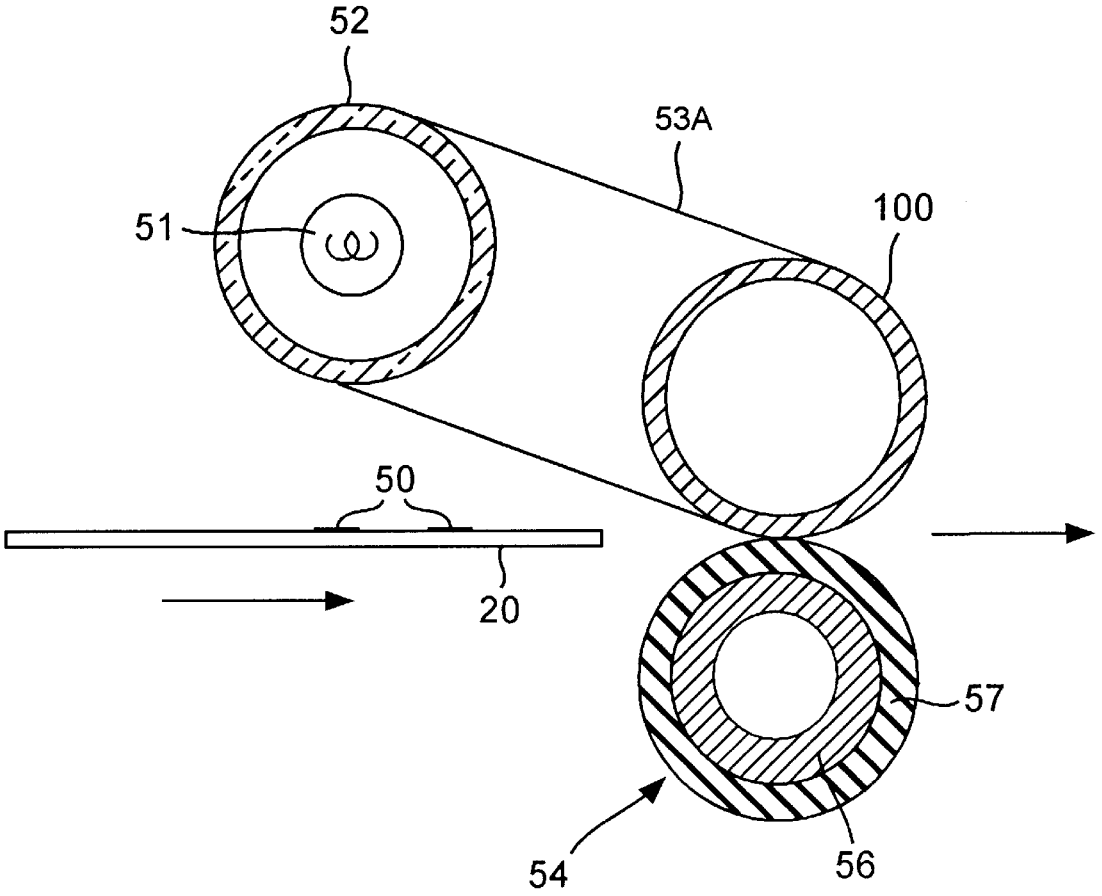
FIG. 4 is a schematic cross-sectional drawing of the fixing device according to the second embodiment of the present invention.

FIG. 4 is a schematic vertical cross section of the fixing device of the second embodiment of the present invention. The same reference keys are used to denote the members similar to those shown in FIG. 1 through FIG. 3.

The second embodiment shown in the figure is different from the first embodiment in that the constitution of the heating rotary member is changed. While the first embodiment comprises, as shown clearly in FIG. 2, the cylindrical sleeve 53 surrounding the hollow cylindrical glass roller 52 which carries in its inside the halogen heater 51, the second embodiment comprises a belt-like member 53A that operates between the hollow cylindrical glass roller 52 and the roller 100.

As explained in the above, the present invention proves a fixing device with a radiant heating source that is capable of reducing the warm up time, while securing a sufficient pressing force required for the fixing operation.

It is obvious that this invention is not limited to the particular embodiments shown and described above but may be variously changed and modified without departing from the technical concept of this invention.

The entire disclosure of Japanese Patent Application No. 09-132218 filed on May 22, 1997, including the specification, claims, drawings and summary are incorporated herein by reference in its entirety.

What is claimed is:

1. A fixing device that fixes an unfixed image, which is formed on a recording medium, onto said recording medium, said fixing device comprising:

a radiant heat source that radiates infrared rays;

an infrared transparent hollow cylindrical member that has said radiant heat source installed therein;

an endless heating rotary member that has said cylindrical member installed therein and is heated by infrared rays from said radiant heat source through said cylindrical member, wherein the hollow cylindrical member and the rotary member are separate members; and a pressure rotary member that is disposed to contact and press said heating rotary member to nip and transport said recording medium, which is holding the unfixed image.

2. A fixing device according to claim 1, in which said radiant heat source comprises a halogen heater.

3. A fixing device according to claim 2, in which said cylindrical member comprises a glass roller.

4. A fixing device according to claim 1, in which said heating rotary member comprises a thin metallic sleeve.

5. A fixing device according to claim 4, in which said metallic sleeve is made of nickel.

6. A fixing device according to claim 4, in which said metallic sleeve is made of copper.

7. A fixing device according to claim 4, in which said metallic sleeve is made of aluminum.

8. A fixing device according to claim 4, in which said metallic sleeve is made of an alloy of copper and aluminum.

9. A fixing device according to claim 4, in which said metallic sleeve is made of stainless steel.

10. A fixing device according to claim 1, in which said heating rotary member has a wall thickness of 40 $\mu$m to 2 mm.

11. A fixing device according to claim 1, in which said heating rotary member that accepts infrared rays from said radiant heat source has its inner surface coated with heat-resistant black paint.

12. A fixing device according to claim 11, in which said heating rotary member has a releasing layer formed on its external surface to improve release properties to said recording medium.

13. A fixing device according to claim 12, in which said releasing layer is made of a heat-resistant resin.

14. The fixing device according to claim 1, wherein the rotary member is not fixed to the cylindrical member.

15. The fixing device according to claim 1, wherein the rotary member fits loosely about the cylindrical member.

16. The fixing device according to claim 1, wherein an outer diameter of the cylindrical member is smaller than an inner diameter of the rotary member.

17. An image recording apparatus comprising:

an image forming unit that forms unfixed images on recording media; and a fixing device that receives said recording media holding unfixed images formed in said image forming unit and fixes said unfixed images on said recording media, said fixing device comprising:

a radiant heat source that radiates infrared rays, an infrared transparent hollow cylindrical member that has said radiant heat source installed therein, an endless heating rotary member that has said cylindrical member installed therein and is heated by infrared rays from said radiant heat source through said cylindrical member, wherein the hollow cylindrical member and the rotary member are separate members, and a pressure rotary member that is disposed to contact and press said heating rotary member to nip and transport said recording medium, which is holding an unfixed image.

18. An image recording apparatus according to claim 17, in which said cylindrical member comprises a glass roller.

19. An image recording apparatus according to claim 17, in which said heating rotary member comprises a thin metallic sleeve.

20. An image recording apparatus according to claim 17, in which said heating rotary member has a wall thickness of 40 $\mu$m to 2 mm.

21. An image recording apparatus according to claim 17, in which said heating rotary member that accepts infrared rays from said radiant heat source has its inner surface coated with heat-resistant black paint.

22. An image recording apparatus according to claim 21, in which said heating rotary member has a releasing layer formed on its external surface to improve release properties to said recording media.

23. An image recording apparatus according to claim 17, in which said radiant heat source is turned on in response to image forming start signal.

24. The image recording apparatus according to claim 17, wherein the rotary member is not fixed to the cylindrical member.

25. The image recording apparatus according to claim 17, wherein the rotary member fits loosely about the cylindrical member.

26. The fixing device according to claim 17, wherein an outer diameter of the cylindrical member is smaller than an inner diameter of the rotary member.

* * * * *